US009163845B1

(12) United States Patent
Carlozzi

(10) Patent No.: US 9,163,845 B1
(45) Date of Patent: Oct. 20, 2015

(54) GARAGE VENTILATION SYSTEM

(76) Inventor: D. George Carlozzi, Antioch, IL (US)

( * ) Notice: Subject to any disclaimer, the term of this patent is extended or adjusted under 35 U.S.C. 154(b) by 536 days.

(21) Appl. No.: 13/571,187

(22) Filed: Aug. 9, 2012

Related U.S. Application Data

(60) Provisional application No. 61/521,861, filed on Aug. 10, 2011.

(51) Int. Cl.
*F24F 7/013* (2006.01)
*F04D 25/12* (2006.01)

(52) U.S. Cl.
CPC ..... *F24F 7/013* (2013.01); *F04D 25/12* (2013.01)

(58) Field of Classification Search
CPC ..... Y02B 30/20; Y02B 30/22; Y02B 30/26; A01K 1/0064; A01K 1/0076; F24F 7/013; F04D 25/12
USPC ..... 454/249, 272, 277, 209
See application file for complete search history.

(56) References Cited

U.S. PATENT DOCUMENTS

| | | | | | |
|---|---|---|---|---|---|
| 1,687,843 | A | * | 10/1928 | Miller | 454/272 |
| 1,713,648 | A | * | 5/1929 | Feinberg et al. | 454/272 |
| 1,930,794 | A | * | 10/1933 | Freeman | 454/272 |
| 2,036,597 | A | * | 4/1936 | Meyrowitz | 392/365 |
| 2,285,161 | A | * | 6/1942 | Jenn | 454/272 |
| 2,590,952 | A | * | 4/1952 | Fukal | 49/87.1 |
| 2,616,498 | A | * | 11/1952 | Wisner et al. | 160/104 |
| 2,619,023 | A | * | 11/1952 | Kisling | 454/209 |
| 2,620,721 | A | * | 12/1952 | Krauss | 454/209 |
| 2,644,390 | A | * | 7/1953 | Delf et al. | 454/209 |
| 2,715,495 | A | * | 8/1955 | Sebastian | 416/246 |
| 2,733,002 | A | * | 1/1956 | Huck | 417/338 |
| 2,753,787 | A | * | 7/1956 | Heiman | 454/209 |
| 2,830,779 | A | * | 4/1958 | Wentling | 248/662 |
| 2,857,095 | A | * | 10/1958 | Suarez | 416/246 |
| 3,173,478 | A | * | 3/1965 | Maycen | 165/121 |
| 3,927,709 | A | | 12/1975 | Anderson et al. | |
| 4,222,318 | A | * | 9/1980 | Patton et al. | 454/209 |
| 4,341,151 | A | * | 7/1982 | Sakamoto | 454/209 |
| 4,372,197 | A | * | 2/1983 | Augsburger | 454/272 |
| 4,557,321 | A | * | 12/1985 | von Resch | 165/122 |
| 4,720,622 | A | * | 1/1988 | Iwata et al. | 219/391 |
| 4,743,739 | A | * | 5/1988 | Tateishi | 392/365 |
| 4,770,087 | A | | 9/1988 | Danley et al. | |
| 4,838,151 | A | * | 6/1989 | Shin-Chin | 454/200 |
| 4,972,570 | A | * | 11/1990 | Tateishi | 29/453 |
| 5,215,498 | A | * | 6/1993 | Wong et al. | 454/208 |
| 5,611,382 | A | | 3/1997 | Sferra | |
| 5,947,814 | A | * | 9/1999 | Czeck et al. | 454/195 |
| 6,336,793 | B1 | * | 1/2002 | Litvin | 417/360 |

(Continued)

*Primary Examiner* — Steven B McAllister
*Assistant Examiner* — Frances F Hamilton
(74) *Attorney, Agent, or Firm* — Crossley Patent Law

(57) ABSTRACT

A garage ventilation system including a housing body with side walls and rear and front mounting plates with louvered vents on the front mounting plates. Support frames vertically disposed on the rear mounting plate have a channel longitudinally disposed therein and a stop body disposed within an outer end thereof. A mount bracket engages each of the channels. Legs disposed on each side of a central pivot member engage the respective channel with termination at the stop body. The mount brackets extend outwardly and away from the rear mounting plate. A fan casing, having a fan disposed therein, is rotatingly mounted to the mount brackets allowing rotation of the fan into an exhaust position and an alternate intake position to direct airflow away from or alternately into a garage. A heater contained within the housing body generates heated airflow directed by the fan.

2 Claims, 4 Drawing Sheets

(56) References Cited

U.S. PATENT DOCUMENTS

| | | | | |
|---|---|---|---|---|
| 6,386,969 | B1 * | 5/2002 | O'Brien | 454/195 |
| 6,524,181 | B2 * | 2/2003 | Wasson | 454/195 |
| 7,510,156 | B1 * | 3/2009 | Yaeger | 248/284.1 |
| 2009/0084507 | A1 * | 4/2009 | Tescher | 160/44 |
| 2009/0124189 | A1 * | 5/2009 | Barber | 454/258 |
| 2010/0176266 | A1 * | 7/2010 | Minkley et al. | 248/476 |
| 2011/0108700 | A1 * | 5/2011 | Wheeler | 248/636 |
| 2012/0012424 | A1 * | 1/2012 | Bowman | 182/129 |

* cited by examiner

GARAGE VENTILATION SYSTEM

I claim benefit of my U.S. Provisional Application No. 61/521,861 filed on Aug. 10, 2011.

BACKGROUND OF THE INVENTION

Various types of garage ventilation systems are known in the prior art. However, what is needed is a garage ventilation system including a housing body having a pair of side walls and rear and front mounting plates with louvered vents on the front mounting plates. Support frames vertically disposed on the rear mounting plate have a channel longitudinally disposed therein and a stop body disposed within an outer end thereof. A mount bracket engages each of the channels. Legs disposed on each side of a central pivot member engage the respective channel with termination at the stop body. The mount brackets extend outwardly and away from the rear mounting plate. A fan casing, having a fan disposed therein, is rotatingly mounted to the mount brackets allowing rotation of the fan into an exhaust position and an alternate intake position to direct airflow away from or alternately into a garage. A heater contained within the housing body generates heated airflow directed by the fan.

FIELD OF THE INVENTION

The present invention relates to garage ventilation systems, and more particularly, to a garage ventilation system mounted to a panel of a garage door including a housing body that has vents and a fan rotatingly mounted thereto to direct airflow into and away from a garage interior.

SUMMARY OF THE INVENTION

The general purpose of the present garage ventilation system, described subsequently in greater detail, is to provide a garage ventilation system which has many novel features that result in a garage ventilation system which is not anticipated, rendered obvious, suggested, or even implied by prior art, either alone or in combination thereof.

To accomplish this, the present garage ventilation system includes a hollow housing body configured to mount to a panel of a garage door. The housing body includes a pair of side walls, a front mounting plate having louvered vents disposed therein, and a rear mounting plate. A pair of support frames is vertically disposed on the rear mounting plate with a channel longitudinally disposed therein and a stop body disposed within each of an outer end of each channel. A mount bracket engages each of the channels. Legs disposed on each side of a central pivot member engage the respective channel with the engagement terminating at the respective stop body. The mount brackets extend outwardly and away from the rear mounting plate. A fan casing, having a fan disposed therein, is rotatingly mounted to the mount brackets. The fan has an exhaust position in which the blades are directed toward the rear mounting plate and an alternate intake position in which the blades are directed away from the rear mounting plate with the fan casing to permit airflow from the operation of the fan to be directed from an interior environment, such as a garage, and alternately to be directed toward an interior environment. To alternate the fan from the exhaust position to the intake position, a user rotates the fan casing to place the fan in the desired exhaust position or intake position.

A heater is removably contained within the housing body and aligns with the fan. Heated airflow generated by the heater is directed by the fan in the intake position into the interior environment.

Thus has been broadly outlined the more important features of the present garage ventilation system so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
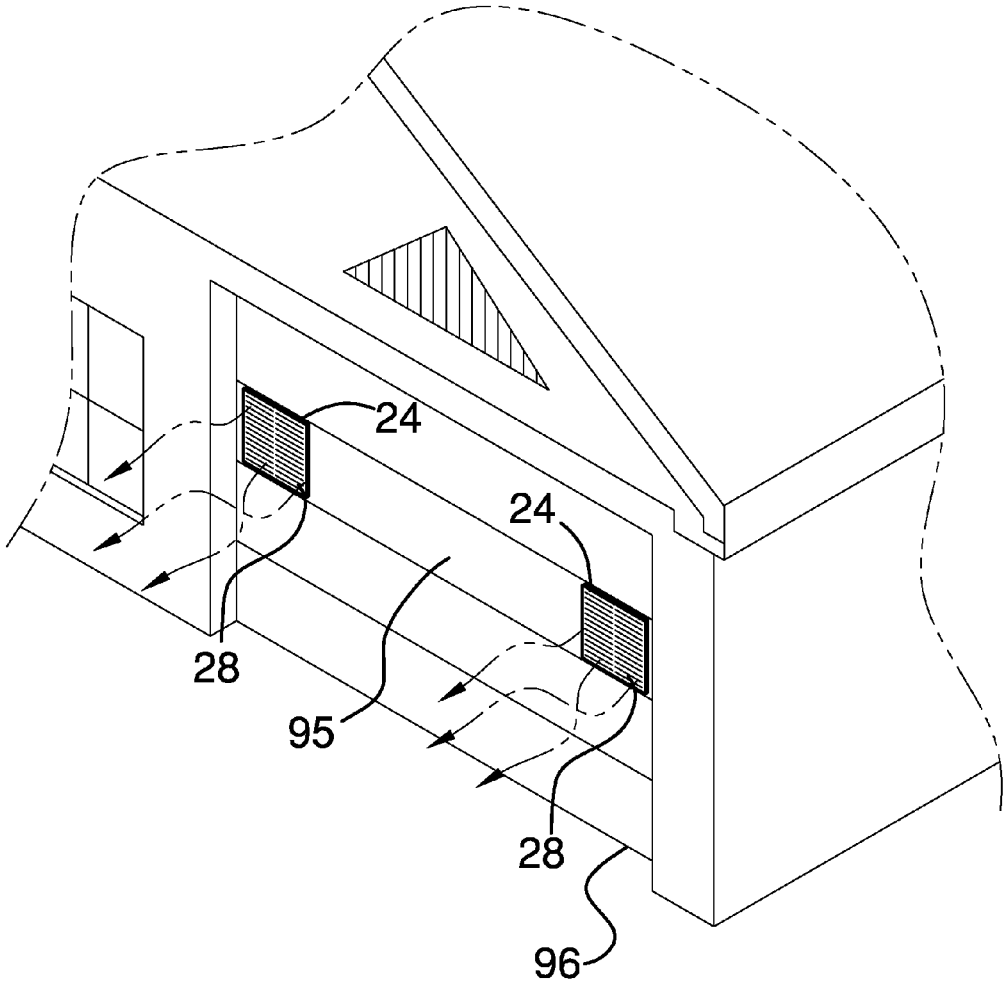
FIG. 1 is an isometric view of at least one vent cover disposed on a garage door.
Figure 2:
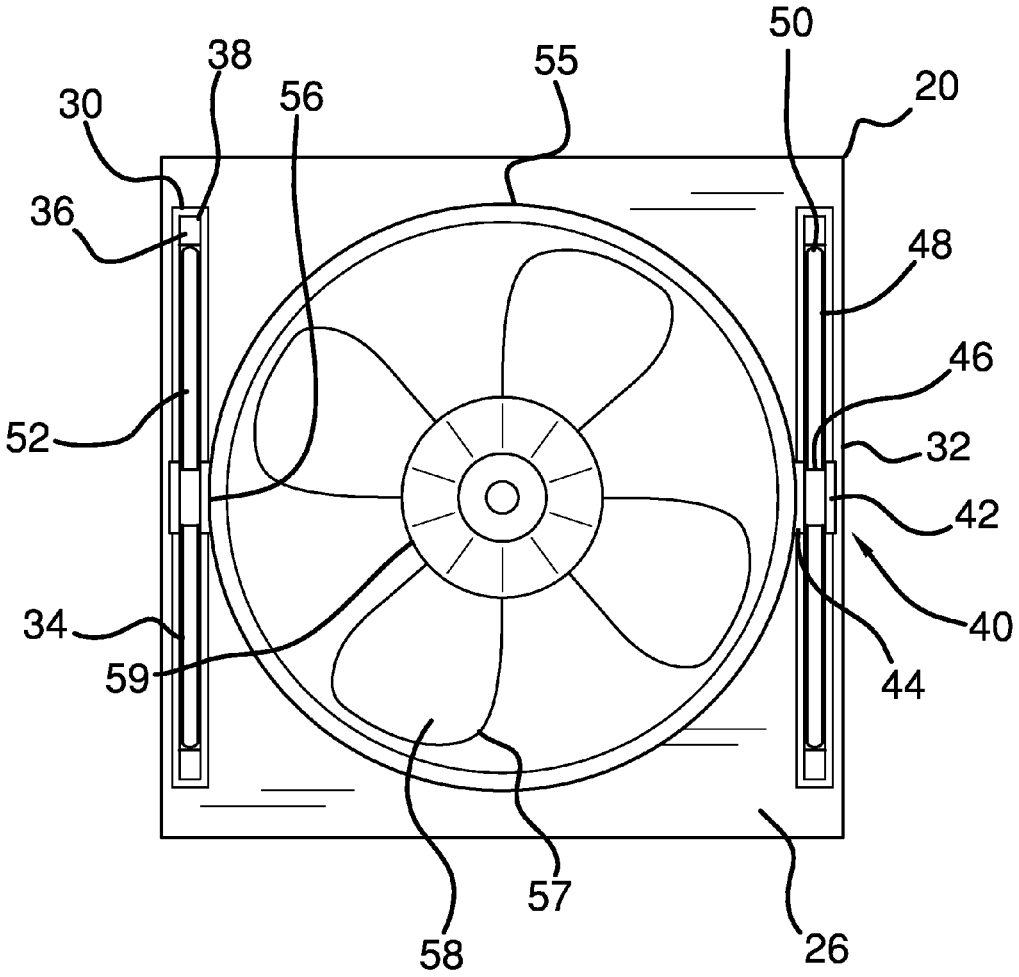
FIG. 2 is a rear elevation view of the fan unit mounted onto a rear mounting plate.
Figure 3:
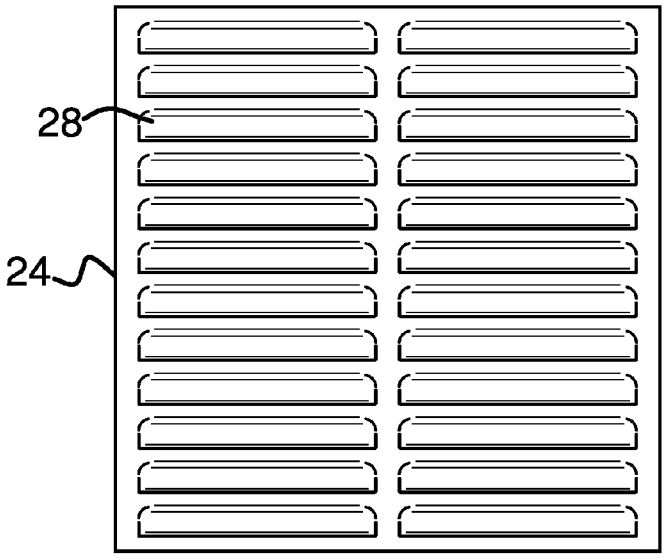
FIG. 3 is a front elevation view of the vent cover.
Figure 4:
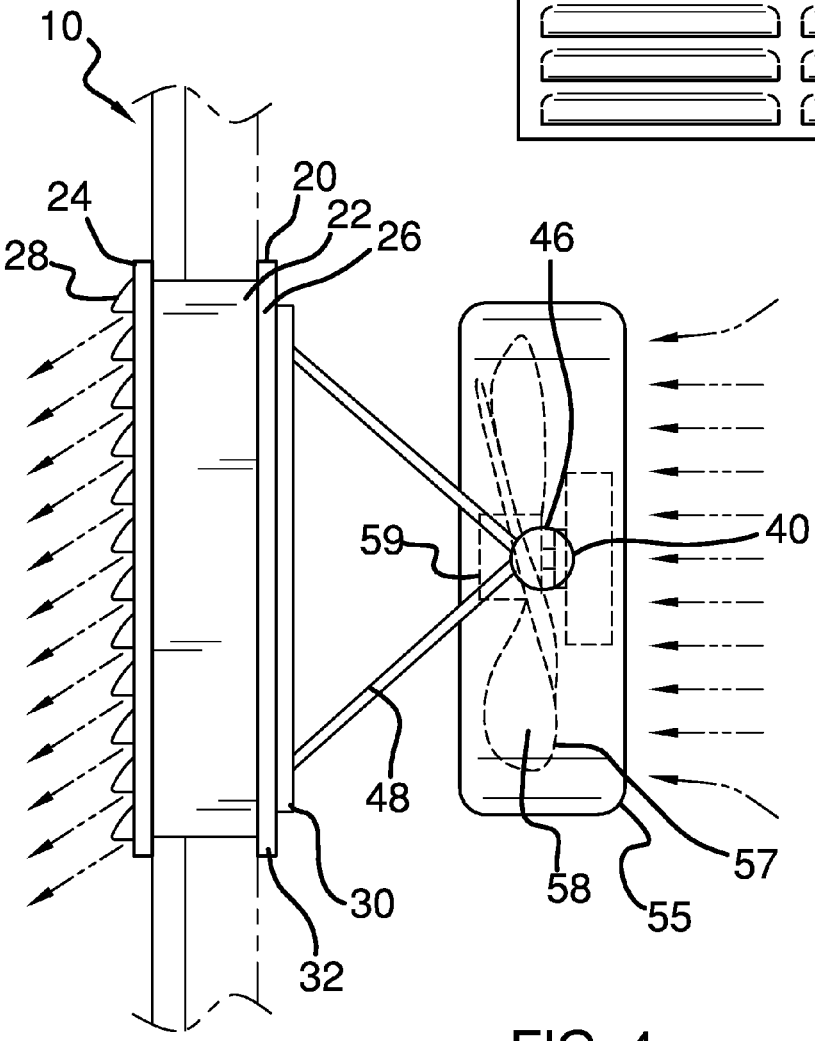
FIG. 4 is a side elevation view of the housing body installed in a garage door and the fan unit mounted thereto.
Figure 5:
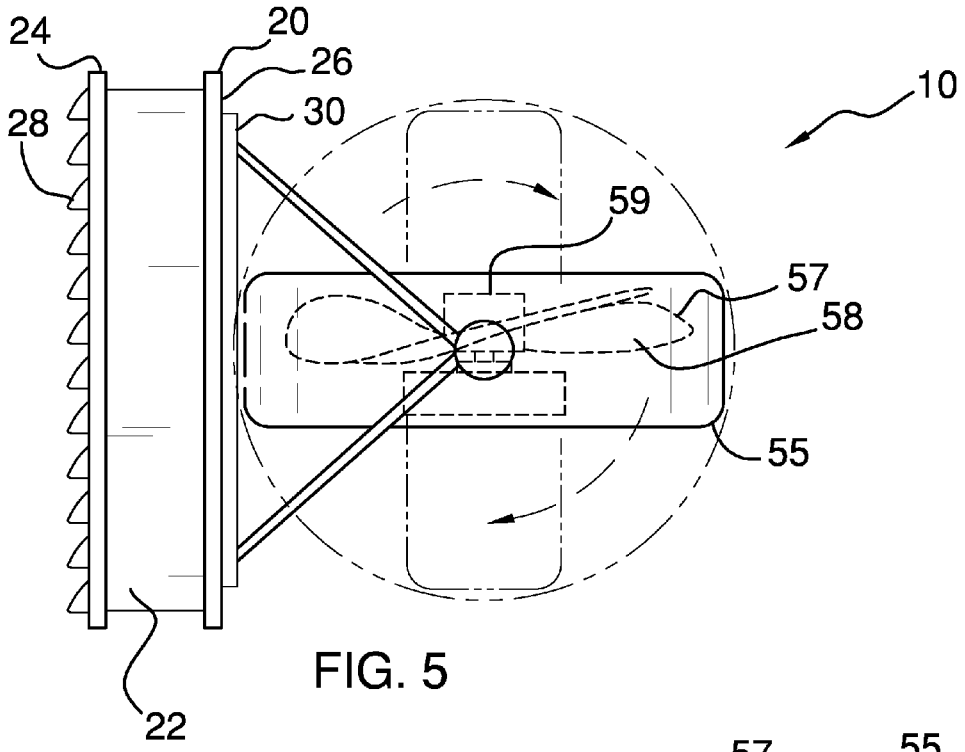
FIG. 5 is a side elevation detail view of the fan unit body rotatingly mounted on mounting brackets to permit reverse air flow.
Figure 6:
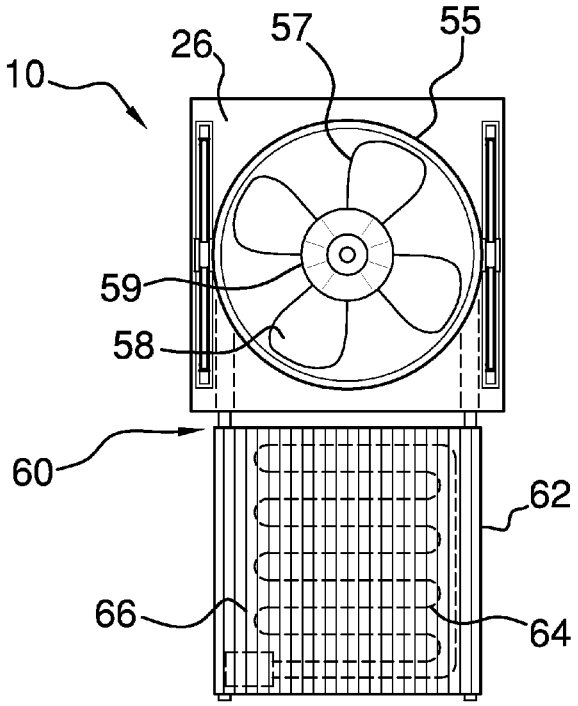
FIG. 6 is an exploded rear elevation view of a heater to be mounted within a cavity of the housing body.

With reference now to the drawings, and in particular FIGS. 1 through 6 thereof, example of the instant garage ventilation system employing the principles and concepts of the present garage ventilation system and generally designated by the reference number 10 will be described.

Referring to FIGS. 1 through 6 a preferred embodiment of the present garage ventilation system 10 is illustrated. The garage ventilation system 10 includes a hollow housing body 20 configured to mount to a panel 95 of a door 96, such as a garage door. The housing body 20 includes a pair of side walls 22, a front mounting plate 24, and a rear mounting plate 26 disposed opposite the front mounting plate 24. A plurality of louvered vents 28 is disposed on the front mounting plate 24. The louvered vents 24 are disposed in at least one vertical column.

A pair of support frames 30 is vertically disposed on the rear mounting plate 26 proximal to a respective side surface 32 of the rear mounting plate 26 in a position parallel to each other. A channel 34 is longitudinally disposed within each of the support frames. A stop body 36 is disposed within each of an outer end 38 of each channel 34.

A mount bracket 40 engages each of the channels 34. Each mount bracket 40 has an external portion 42, an internal portion 44, a central pivot member 46 disposed therebetween, and a leg 48 disposed on each side of the central pivot member 46. The legs 48 engage the respective channel 34 terminating at the respective stop body 36. The mount brackets 40 extend outwardly and away from the rear mounting plate wherein an outer end 50 of each leg 48 abuts the respective stop body 36. The central pivot member 46 is horizontally aligned with a center point 52 of the respective channel 34.

A fan casing 55 having opposite side portions 56 is provided. Each of the side portions 56 is rotatingly mounted to a respective internal portion 44 of each mount bracket 40. A rotary fan 57 is disposed within the fan casing 55. The fan 57 includes a plurality of blades 58 and a motor 59 centrally disposed within the fan casing. The motor 59 operationally engages the blades 58. The fan 57 has an exhaust position in which the blades 28 are directed toward the rear mounting plate 26 upon placement of the fan casing 55 in a retracted position and an alternate intake position in which the blades 58 are directed away from the rear mounting plate 26 with the fan casing 55 disposed in a retracted position. In the exhaust position, airflow from the operation of the fan 57 is directed from an interior environment, such as a garage, through the fan first and then between the side walls 22, followed by the exhaust of airflow through the vents 28 into an exterior environment, such as outdoors. In the intake position, airflow from the operation of the fan 57 is drawn through the vents 28 by the fan 57, between the side walls 22, and into the interior environment. To change the fan 57 from the exhaust position to the intake position and vice versa, a user rotates the fan casing 55 to place the fan 57 in the desired exhaust position or intake position.

A heater 60 is configured to be removably contained within the housing body 20 between the side walls 22 and the front mounting plate 24 and the rear mounting plate 26 in a position of alignment with the fan 57 upon disposition of the mount bracket 49 in the retracted position. The heater 60 includes an encasement 62. The heater 60 can include a plurality of heating elements 64 disposed within the encasement 62, but can also include other types of heaters. A heat plate 66 configured to store heat generated by the heater 60 is disposed upon at least one side of the encasement 62. The heater 60 is configured to be used upon placement of the fan 57 in the intake position.

The motor 59 is powered by a power source, such as electricity.

What is claimed is:

1. A garage ventilation system comprising:

a hollow housing body configured to mount to a panel of a garage door, the housing body comprising:
- a pair of side walls;
- a front mounting plate;
- a rear mounting plate;
- a plurality of louvered vents disposed within the front mounting plate;

a pair of support frames vertically disposed on the rear mounting plate proximal to a respective side wall in a position parallel to each other;

a channel longitudinally disposed within each of the support frames;

a stop body disposed within each of an outer end of each channel;

a mount bracket engaging each of the channels and terminating at the respective stop body, wherein each mount bracket extends outwardly and away from the rear mounting plate, wherein each of the mount brackets comprise:
- an external portion;
- an internal portion;
- a central pivot member disposed therebetween;
- a leg disposed on each side of the central pivot member; wherein the legs engage the respective channel;

a fan casing having side portions opposite each other, each side portion rotatingly mounted to a respective internal portion of each mount bracket;

a rotary fan disposed within the fan casing;

a plurality of blades of the fan;

a motor centrally disposed within the fan casing;

wherein the motor operationally engages the blades;

wherein the fan has an exhaust position in which the blades are directed toward the rear mounting plate;

wherein the fan has an intake position in which the blades are directed away from the rear mounting plate;

wherein in the exhaust position, airflow from the operation of the fan is directed from an interior environment through the fan first and then through the cavity, followed by the exhaust of airflow through the vents into an exterior environment, such as outdoors;

wherein in the intake position, airflow from the operation of the fan is drawn through the vents by the fan, through the cavity, and into the interior environment; and a heater configured to be removably contained within the housing body;

wherein the heater comprises:
- an encasement;
- a heat plate disposed upon at least one side of the encasement wherein the heat plate is configured to store heat generated by the heater and to allow the passage of air from the fan in the intake position through the vents.

2. The garage ventilation system of claim 1 wherein the heater is disposed in a position of alignment with the fan within the housing body; and wherein the heater is configured to be used upon placement of the fan in the intake position.

* * * * *